United States Patent [19]

Fleury

[11] 4,398,637

[45] Aug. 16, 1983

[54] METHOD AND SYSTEM FOR GRADING AND SORTING ARTICLES

[75] Inventor: Guy Fleury, Quebec, Canada

[73] Assignee: Dicta-Son Inc., Quebec, Canada

[21] Appl. No.: 218,209

[22] Filed: Dec. 19, 1980

[51] Int. Cl.[3] ..... B07C 3/20; B07C 5/24

[52] U.S. Cl. ..... 209/546; 209/3.3; 209/592; 209/912; 209/942; 414/136

[58] Field of Search ..... 209/3.1, 3.2, 3.3, 546, 209/592, 593, 594, 595, 912, 942; 198/504, 505; 414/134, 136; 340/673, 674, 676

[56] References Cited

U.S. PATENT DOCUMENTS

| | | | |
|---|---|---|---|
| 3,563,395 | 2/1971 | Gary | 414/136 |
| 3,696,946 | 10/1972 | Hunter et al. | 414/134 |
| 4,021,336 | 5/1977 | Brook et al. | 209/593 X |
| 4,058,217 | 11/1977 | Vaughan et al. | 414/136 X |
| 4,256,569 | 3/1981 | Wallace | 209/942 X |

*Primary Examiner*—Robert B. Reeves
*Assistant Examiner*—Edward M. Wacyra
*Attorney, Agent, or Firm*—Oblon, Fisher, Spivak, McClelland & Maier

[57] ABSTRACT

A method and a system for grading and sorting articles comprising a conveyor for sequentially conveying a plurality of articles passed a coding station. The coding station identifies a first one of a plurality of articles with an electronically stored information code indicative of specific characteristics of the first article. A sequentially operable visual indicator device identifies the location of the first article moving along a predetermined portion of the conveyor line at the coding station where the information code is to be stored. The visual indicator is activated until the information code is completed and a termination signal to that effect is generated. The visual indicator then identifies the following article as being a first article in the predetermined portion.

12 Claims, 2 Drawing Figures

METHOD AND SYSTEM FOR GRADING AND SORTING ARTICLES

BACKGROUND OF INVENTION (a) Field of the Invention

The present invention relates to a system and a method of grading and sorting articles and more particularly, but not exclusively, for grading and sorting articles of livestock and providing an electronic information code indicative of specific characteristics of the livestock.

(b) Description of Prior Art

It is necessary to process livestock before they reach the marketplace whereby to determine if such livestock meets the regulation of food and drug agencies as to the quality of the meat. Furthermore, it is necessary to weight the livestock and determine the fat content thereof before the owner can be paid for his product. Often, there is considerable delay in making the payment to the owner as the processing of large quantities of livestock is time-consuming, particularly when some livestock is rejected and complex calculations have to be made to take into account rejections and fat rate of all of the articles of a particular owner. Often, the payment made to the owner is not very precise. Still further, the information gathered is not properly used in compiling statistics to supply requested information to the Government. The owners of livestock also require information, such as the best type of feed to use for minimum fat content, this being determined by the processing of livestocks coming from different owners employing different feeds. Another disadvantage in the processing of such livestock is that it is a very time-consuming task to code the livestock, obtain the various statistics on an individual article of livestock, and document such information.

SUMMARY OF INVENTION

It is a feature of the present invention to substantially overcome all of the above-mentioned disadvantages.

A further feature of the present invention is to provide an identification system wherein an information code is automatically stored indicative of specific characteristics of the livestock and wherein the signal is used to separate livestock to be further processed from a main stream of livestock along a conveyor line.

A further feature of the present invention is to provide an identification system for grading and sorting articles of livestock and wherein the speed of operation of the system is variable and controlled in relation to the time lapse to complete the storage of the information code of the articles being conveyed passed a coding station.

A further feature of the present invention is to provide a method for grading and sorting articles and providing an electronic identification code for each article conveyed sequentially passed a coding station with a first one of the articles being visually indicated as it moves along a conveyor line until such first article has been assigned an identification code.

According to the above features, from a broad aspect, the present invention provides an identification system for grading and sorting articles comprising conveyor means for sequentially conveying a plurality of articles. A coding station is provided for identifying a first one of the plurality of articles with electronically stored information code indicative of specific characteristics of that article. Sequentially operable indicator means visually identifies the location of the first article moving along a predetermined portion of the conveyor line at the coding station where the information code is to be stored and until the information code is completed and a termination signal to that effect is generated whereby a following article is visually indicated by the indicator means as being a first article in the predetermined portion and identified with its information code.

According to a further broad aspect of the present invention, there is provided a method for grading and sorting articles and providing an electronic identification code for each article. The method comprises the steps of sequentially conveying a plurality of the articles passed a coding station. The position of a first article to be coded is visually indicated amongst a plurality of articles. A sequential identification number is generated for each article as it is conveyed along the coding station. Coded signals are stored in the information signal and indicative of specific characteristics of each first article of the articles passed the coding station.

BRIEF DESCRIPTION OF DRAWINGS

A preferred embodiment of the present invention will now be described with reference to the example thereof illustrated in the accompanying drawings in which.

DESCRIPTION OF PREFERRED EMBODIMENTS

Figure 1:
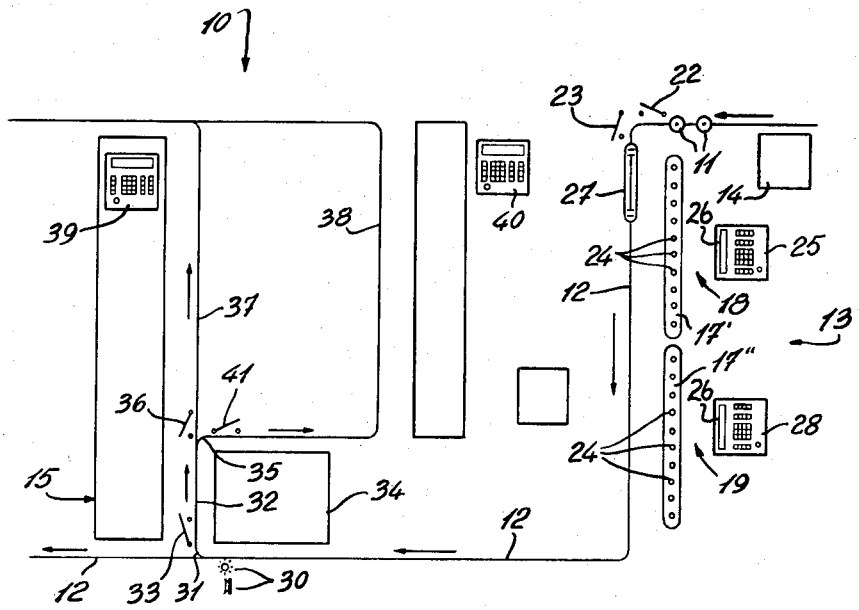
FIG. 1 is a schematic view showing the system and method of the present invention.

Referring now to the drawings, and more particularly to FIG. 1, there is shown generally at 10, the identification system of the present invention for grading and sorting articles 11 which are conveyed along a conveyor line 12 with the article passing in front of a coding station 13. The particular system herein illustrated was conceived for grading and sorting articles of livestock but it is fully within the scope of the present invention to use the method and system for processing other articles which are capable of being conveyed in front of a coding station by any conveying means.

In the processing of articles of livestock, it is firstly necessary to inspect the articles before they are graded and this is done at an inspection station 14. Here, an inspector will examine the livestock for any trace of illness and if illness is found or suspected, a tag is placed on the article of livestock requiring further examination at a processing station 15 downstream of the conveyor 12. If minor trimming is required, it may be completed between the coding station 13 and the processing station 15 and the article of livestock will then be segregated at its entry to the processing station as will be described later. Also, as shown in FIG. 2, each article of livestock is provided with an identification number 16 printed thereon to identify the article with its owner.

The articles 11 are sequentially fed to the coding station 13 whereby a first one of a plurality of articles 11 may be identified with an electronically stored information code indicative of specific characteristics of that article. This first article is identified amongst all other articles by a sequentially operable indicator means 17, herein constituted by a first and second group of light sources 17' and 17'' each associated respectively with an identification number and weighing station 18 and a grading station 19, both stations 18 and 19 constituting the coding station 13.

Figure 2:
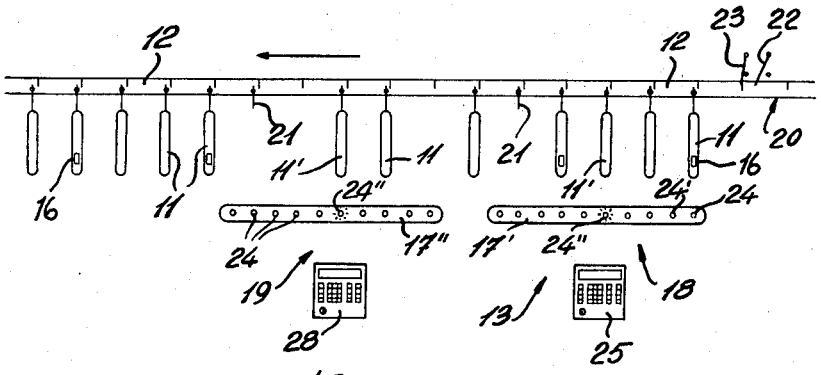
FIG. 2 is a schematic illustration showing the coding station.

Referring now additionally to FIG. 2, it can be seen that as the articles 11 arrive at an input end 20 of a predetermined portion of the conveyor line which passes the coding station 13, the hooks 21 which hold the articles of livestock 11 will activate switch means herein constituted by a half length pusher switch 22 and a pusher detect switch 23. The hooks 21 are secured to the conveyor line at a distance between each other equivalent to the distance between two adjacent lights 24 which are equidistantly spaced from one another along the first and second group of lights 17' and 17''.

As a first one of the articles 11 arrive at the identification and weighing station 18, the first light will be lit by circuit means (not shown) activated by the pusher detect switch 23 sensing the article immediately thereafter. As the first of the articles is moved along the identification weighing station 18, the second light 24' will be lit by the third article (not shown) following the second article which has now engaged the half length pusher switch 22. As the first article continues to move along the station 18, the fourth article will then light the following light 24 and so on along the first group of lights 17'. Thus, as the first article which entered the station 18 moves along the group of lights 17', its position is indicated by one of the lights 24. The synchronization of the lights at either station 18 and 19 is dependent on the activation of the pusher detect switches 22 and 23. Both switches advance the lights by one as the article moving on the conveyor triggers the switches. However, the pusher detect switch 23 also increments the sequence number by one to identify the next article. At that time a check is made to determine if the article passing in proximity of location 30 should go to processing section 15. If the article is to enter the processing station 15, a light and audible alarm will go on at the location 30 indicating to an operator at station 34 that he should activate switch 31. After activation of switch 31, the article 11 will be rerouted to the processing section 15 and detected by switch 33. As the article moves along station 18, an operator has activated a keyboard entry module 25 by the insertion of an identification key (not shown) thereinto. This key identifies the operator and places the module 25 in operation. The module is provided with display means 26, (as is well known in the art) for displaying an identification information code. This code comprises a sequence number which was sequentially activated by the detect pusher switch 23 and modified by a termination signal generated at the module 25 by the operator. The code further comprises information relating to the weight of the article. This weight is ascertained by means of the weigh scale 27 located at the input end of the conveyor line. This weight is visually displayed to the operator who then keys in the information into the information code display, prior to generating the termination signal. Once the termination signal is generated, the light source associated with the subsequent article 11 is then lit. This article is shown in FIG. 2 as being 11' with light 24'' being lit.

It can be appreciated that the operator must complete the entry of the information code before the last light on the first group of lights 17' is lit. If the operator fails to complete the information signal before the last light is lit, that information signal associated with that article will later cause the article to move into the processing station 15. It is foreseen that the modules 25 and 28 may also be provided with means to stop the conveyor line whereby the operator can then read the information in his module relating to the sequential number and weight of the subsequent article and enter that information into the next information code and generate a termination signal whereby to continue his function. However, in this application, modules 25 and 28 are not used to stop the conveyor line. However, all stations 25, 28, 39 and 40, can be so equipped. With this particular indicator means, it is possible to control the speed of the conveyor line 12 in relation to the time lapse to complete the storage of the information code by the operators at stations 18 and 19. The faster the information is stored in the module, the faster the conveyor line may be run. Thus, the system will provide an increase in production as the operators become more efficient and are controlled by the groups of lights 17' and 17''.

The conveyor is motor driven as is well known in the art and the speed of the conveyor is controlled by the speed of the motor. A motor speed control device (not shown) but obvious to a man skilled in the art can synchronize the motor speed to the time lapse to complete the storage of the information code.

As the articles 11 continue to move passed the second group of lights at the grading station 19, the amount of fat in the article is measured and a code representative of that amount is then keyed into the information code by means of the keyboard entry module 28 at the grading station. The operation at this station is the same as previously described with reference to the station 18.

Those articles which pass the coding station 13 and which were provided with a ticket or other form of identification means at the inspection station 14 to indicate that they required further processing are also assigned an information code. However, their information code will later be reprocessed as such articles may be of reduced weight for the reason that parts thereof may have been severed at the processing station. When articles are reprocessed along conveyor lines 37 and 38, their code may be modified by modules 25 and 28 to eliminate the need of reprocessing the articles at coding station 13.

Referring now again to FIG. 1, the processing station 15 comprises indicator means, herein constituted by a visual and audible devices at location 30, which are activated at the moment a preselected article 11 reaches a position along the conveyor line 12 in close proximity thereof. This location 30 is synchronized with the sequence of the pusher detect switch 23 and circuit means (not shown but obvious to a man skilled in the art) to identify that that specific article at the precise position requires to be routed into the processing station 15. An entry switch 31 will then permit that preselected article to be conveyed on an entrance conveyor line 32. The article is then conveyed passed an entry detect switch 33 which reroutes the electronic identification code of that preselected article on a first-in-first-out basis. An operator at station 34 will determine if the article needs further processing or not. The operator at station 34 controls the routing of articles. If the article has an identification code (tag) supplied by either the operator at station 14 or 19, the operator at 34 will activate switch 31. The operator at the code identification station 34 activates selected ones of two switches, and namely a rerouting switch 35 or a trimming switch 36. The data line or information signal of each article of livestock entering either the trimming conveyor line section 37 or rerouting conveyor line section 38 is then fed to one of a keyboard entry module 39 or 40 depending on a signal given by the activation of switch 36 or 41. Of course, it may not be necessary to process the articles entering the processing station 15 immediately as the information code can be stored. The modules 39 and 40 may be operated part time depending on the rate of entry of articles into the processing station 15 as the conveyor line sections 37 and 38 could be constructed sufficiently long to accumulate articles to be trimmed or reprocessed as to their weight and fat content. Information relating to the complete description of said articles can be processed at a number of modules of the type as 25 and 28 and be reprocessed at a number of modules of the same type as modules 39 and 40. The reprocessing section can be independent of the conveyor line.

Briefly summarizing the operation of the system, the articles of livestock are inspected at station 14 and particular ones are tagged for trimming. As the first one of a plurality of these articles enters the coding station, and more specifically, the identification and weight station 18 thereof, a light 24 of a plurality of lights is lit to identify the location of that first article as it moves along station 18. During its movement time, the article is weighed, it is assigned a sequential number and this information is stored in an information coded signal. The information code is comprised of the sequence number, the weight, the grade, the trimming weight, and the illness of the article in question. Also, the complete information code includes the time of execution, the person performing the operation, and the date. Presently, the information keyed in at module 25 is the identification code. The specific dead weight of the article is automatically entered into the module 25 through an interconnection (not shown) with the scale 27.

Articles to be rerouted into the processing station 15 are identified by the indicators at location 30 and their information signal is read to determine whether they should be trimmed or reprocessed.

It is within the gambit of the present invention to cover any obvious modifications of the example described herein, provided such modifications fall within the scope of the appended claims.

I claim:

1. An identification system for grading and sorting articles comprising a conveyor line for sequentially conveying a plurality of articles, a coding station for identifying a first one of said plurality of articles with an electronically stored information code indicative of specific characteristics of said first article, and sequentially operable indicator means to visually identify the location of said first article moving along a predetermined portion of said conveyor line at said coding station where said information code is to be stored until said information code is completed and a termination signal to that effect is generated whereby a following article is visually indicated by said indicator means as being a first article in said predetermined portion of said conveyor line and identified with its information code, said indicator means being a plurality of light sources positioned along said predetermined portion of said conveyor line, said light sources being illuminated momentarily in sequence and in alignment with said first one of said articles moving along said conveyor line, said light sources being illuminated for a time duration dependent on the displacement time of said first article along said predetermined portion of said conveyor line.

2. An identification system as claimed in claim 1 wherein said information code comprises a sequence number therein, switch means at an input end of said predetermined portion of said conveyor line to increment a preceding sequence number by one each time said switching means is operated by a subsequent article conveyed therepast on said conveyor line and to sequentially operate said light sources.

3. An identification system as claimed in claim 2 wherein there is further provided conveyor speed control means to control the conveying speed of said articles past at least said predetermined portion of said conveyor line, said rate of displacement of said articles being determined by the time lapse to complete the storage of said information code.

4. An indentification system as claimed in claim 3 wherein said indicator means comprises at least a first and a second group of said plurality of light sources, said information code having a first and a second portion associated respectively with said first and second groups of light sources.

5. An identification system as claimed in claim 4 wherein said articles are articles of livestock required to be identified, weighed and graded, a scale associated with a front end of said predetermined portion of said conveyor line, said scale indicating the weight of each article of livestock fed therepast, each said articles of livestock having an identification number printed thereon, said identification code comprising said sequence number, a weight number and a grade number.

6. An identification system as claimed in claim 5 wherein there is a distance of two light sources between each article of livestock, said switch means comprising a half length pusher switch and a pusher detect switch, said half length pusher switch causing said light sources to increment by one in sequence as said livestock advances on said conveyor line at both groups of light sources, said pusher detect switch also causing said incrementation of said light sources and further causing a counter to advance by one.

7. An identification system as claimed in claim 6 wherein there is further provided an inspection station upstream of said coding station, an indication label securable to some of said livestock indicating further processing thereof in a processing station downstream of said first and second groups of light sources.

8. An identification system as claimed in claim 7 wherein said processing station comprises indicator means to identify specific articles of livestock to be conveyed therepast, said indicator means being synchronized with said pusher detect switch, an entry switch to accept said secific articles to be conveyed on an entrance conveyor line of said processing station, an entry detect switch to route said electronic identification code of each said specific articles of livestock on a first-in first-out basis, a code identification station for activating selected ones of two selection switches to convey said specific articles of livestock along one of two further conveyor lines as determined by said identification code.

9. An identification system as claimed in claim 8 wherein said code identification station and said coding station are activated by an operator identification key activating a keyboard entry module, said module having display means for displaying said identification code and keyboard means to enter information in said identification code and to generate said termination signal.

10. A method for grading said sorting articles and providing an electronic identification code for each said articles comprising the steps of:

(i) sequentially conveying along a conveyor line a plurality of said articles past a coding station;

(ii) simultaneously causing a plurality of light sources at said coding station to light momentarily in sequence and in alignment with a first one of said articles and for a time duration equal to the displacement speed of said first article therepast, (iii) controlling the displacement speed of said articles past said coding station in relation to the time lapse to complete the storage of said information code, (iv) generating a sequential identification number for each article as it is conveyed along said coding station; and (v) storing coded signals in said information signal indicative of specific characteristics of each first article of said articles past said coding station.

11. A method as claimed in claim 10 wherein there is further provided the step of weighing said articles at an input end of said conveyor line past said coding station and displaying the weight of said articles on a keyboard entry module in association with said sequential identification number of said article.

12. A method as claimed in claim 11 wherein there is further provided the step of generating a termination signal indicative of a completed information code for said articles, the absence of such termination signal being indicative to perform further steps of:

(a) identifying said articles in absence of said termination signal as it arrives at a processing station;

(b) conveying said selected articles in absence of said termination signal on an entrance conveyor line;

(c) rerouting the identification code of said selected articles; and (d) analysing said identification code of said selected articles to convey said selected articles along one of two further conveyor lines as determined by said identification code.

* * * * *